US008663891B2

(12) United States Patent
Lee et al.

(10) Patent No.: US 8,663,891 B2
(45) Date of Patent: Mar. 4, 2014

(54) TONER FOR DEVELOPING ELECTROSTATIC LATENT IMAGE AND METHOD OF PREPARING THE SAME

(75) Inventors: Jun-Young Lee, Seoul (KR); Min-Young Cheong, Seoul (KR); Jae-Hwan Kim, Seoul (KR); Yo-Da Shin, Incheon Metropolitan (KR); Tae-Hoe Koo, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 886 days.

(21) Appl. No.: 12/632,188

(22) Filed: Dec. 7, 2009

(65) Prior Publication Data

US 2010/0159379 A1 Jun. 24, 2010

(30) Foreign Application Priority Data

Dec. 22, 2008 (KR) ..... 10-2008-0131198

(51) Int. Cl.
*G03G 9/08* (2006.01)

(52) U.S. Cl.
USPC ..... 430/110.3; 430/110.4; 430/110.2; 430/108.8

(58) Field of Classification Search
USPC ..... 430/108.8, 110.2, 110.4
See application file for complete search history.

(56) References Cited

U.S. PATENT DOCUMENTS

| | | | | |
|---|---|---|---|---|
| 6,329,114 | B1 * | 12/2001 | Watanabe et al. | 430/110.4 |
| 2004/0137352 | A1 * | 7/2004 | McStravick et al. | 430/108.11 |
| 2006/0014094 | A1 * | 1/2006 | Yuasa et al. | 430/108.2 |
| 2006/0127789 | A1 * | 6/2006 | Yuasa et al. | 430/109.1 |
| 2007/0154832 | A1 * | 7/2007 | Hong et al. | 430/110.2 |
| 2008/0166649 | A1 * | 7/2008 | Moffat et al. | 430/108.8 |
| 2009/0136864 | A1 * | 5/2009 | Itou et al. | 430/108.2 |
| 2009/0186290 | A1 * | 7/2009 | Yoshizaki et al. | 430/109.1 |
| 2010/0055598 | A1 * | 3/2010 | Zhou et al. | 430/109.31 |

* cited by examiner

*Primary Examiner* — Mark F Huff
*Assistant Examiner* — Rashid Alam
(74) *Attorney, Agent, or Firm* — Stanzione & Kim, LLP

(57) ABSTRACT

Disclosed are a toner for developing an electrostatic latent image and a method of preparing the same. The toner may include latex, a pigment and a releasing agent. The lowest crossover temperature of the toner at which the storage modulus (G') and the loss modulus (G") of the toner are substantially equal to each other may be in the range of about 65 to about 80° C. The weight average molecular weight (Mw) of the toner may be in the range of about 65,000 to about 75,000. The z-average molecular weight (Mz) of the toner may be in the range of about 110,000 to about 220,000.

19 Claims, 2 Drawing Sheets

TONER FOR DEVELOPING ELECTROSTATIC LATENT IMAGE AND METHOD OF PREPARING THE SAME

CROSS-REFERENCE TO RELATED PATENT APPLICATION

This application claims the benefit of Korean Patent Application No. 10-2008-0131198, filed on Dec. 22, 2008 in the Korean Intellectual Property Office, the disclosure of which is hereby incorporated by reference in its entirety for all purposes.

TECHNICAL FIELD

The present disclosure generally relates to toner for developing an electrostatic latent image and methods of preparing the toner.

BACKGROUND OF RELATED ART

Toner for developing an electrostatic latent image can be prepared using a grinding method (sometimes also referred to as a pulverizing method) or a polymerizing method. In the grinding method, a synthesized resin, a colorant, and optionally other additives are dissolved and mixed together. The resulting mixture is ground into particles, which are classified in order to obtain particles having a desired diameter. In the polymerizing method, a polymerizable monomer, a pigment, a polymerization initiator and optionally other additives such as, for example, a crosslinking agent or an antistatic agent, are homogeneously dissolved or dispersed to form a polymerizable monomer composition. The polymerizable monomer composition may be dispersed with an agitator in an aqueous dispersion medium containing a dispersion stabilizer so as to form droplet particles of the polymerizable monomer composition. The temperature may be increased and a suspension-polymerization process may be performed to obtain color polymerization particles having the desired particle diameters, that is, the polymerization toner.

Characteristics of toner required for electrophotography and electrostatic recording techniques include a small particle diameter and a narrow particle diameter distribution. These properties lead to high image quality and high resolution, low-temperature fixing, high glossiness, and/or longer preservation or storability characteristics. Low-temperature fixing, high glossiness and preservation characteristics may also be obtained by controlling the structure of the toner.

Images formed using an imaging apparatus such as an electrophotographic copier, require a high degree of precision. Conventionally, toner obtained using a grinding method is commonly used in imaging apparatuses. However, when the grinding method is used, colorant particles formed are likely to have a wide particle diameter distribution. Thus, to obtain desirable toner characteristics, the colorant particles need to be classified in order to obtain a narrow particle diameter distribution. With respect to conventional grinding methods, the degree to which toner particle diameter and toner structure can be controlled is limited, and thus the likelihood of a new design having a significant change in the major characteristics of the toner is relatively low.

Recently, polymerization toners of which particle sizes can be easily controlled and prepared without complicated manufacturing processes such as a classifying process have received significant attention. When toner is prepared by polymerization, polymerization toner having a desired particle diameter and distribution can be obtained without a grinding or classifying process. For example, toner can be manufactured using a metal salt such as MgCh or NaCl as an agglomerating agent.

To obtain high printing performance and high image quality, in addition to particle diameter and particle diameter distribution control, other functional properties such as fixing and durability characteristics of toner also need to be considered.

SUMMARY OF THE DISCLOSURE

According to an aspect of the present disclosure, there is provided a toner for developing an electrostatic latent image that may include latex, a colorant and a releasing agent. The lowest crossover temperature of the storage modulus (G') and the loss modulus (G") of the toner may be in the range of about 65 to about 80° C. The weight average molecular weight (Mw) of the toner may be in the range of about 65,000 to about 75,000. The z-average molecular weight (Mz) of the toner may be in the range of about 110,000 to about 220,000.

According to another aspect of the present disclosure, there is provided a method of preparing a toner for developing an electrostatic latent image. The method may include the steps of: mixing a latex particle, a colorant dispersion and a releasing agent dispersion to form a mixture; adding an agglomerating agent to the mixture to form a primary agglomerated toner; and heating the primary agglomerated toner to a temperature that is equal to or higher than the glass transition temperature of the latex particle to coalesce the primary agglomerated toner to form a secondary agglomerated toner. The lowest crossover temperature of the storage modulus (G') and the loss modulus (G") of the toner may be in the range of about 65 to about 80° C. The weight average molecular weight (Mw) of the toner may be in the range of about 65,000 to about 75,000. The z-average molecular weight (Mz) of the toner may be in the range of about 110,000 to about 220,000.

According to yet another aspect of the present disclosure, there is provided a developer for developing an electrostatic latent image. The developer may include a carrier and a toner. The toner may comprise latex, a colorant and a releasing agent. The lowest crossover temperature of the storage modulus (G') and the loss modulus (G") of the toner may be in the range of about 65 to about 80° C. The weight average molecular weight (Mw) of the toner may be in the range of about 65,000 to about 75,000. The z-average molecular weight (Mz) of the toner may be in the range of about 110,000 to about 220,000.

According to even yet another aspect of the present disclosure, there is provided an image forming method that may include the steps of: forming an electrostatic latent image on an image carrier; developing the electrostatic latent image with a developer containing a toner to thereby form a toner image; transferring the toner image, onto a print medium; and fixing the transferred toner image on the print medium. The toner may comprise latex, a colorant and a releasing agent. The lowest crossover temperature of the storage modulus (G') and the loss modulus (G") of the toner may be in the range of about 65 to about 80° C. The weight average molecular weight (Mw) of the toner may be in the range of about 65,000 to about 75,000. The z-average molecular weight (Mz) of the toner may be in the range of about 110,000 to about 220,000.

According to still another aspect of the present disclosure, there is provided a toner supplying unit that may include a toner tank and a supplying part. The toner tank may define a volume into which a supply of toner is received. The supplying part may be arranged to project into the volume defined by the toner tank, and may have a toner outlet through which toner is discharge out of the toner tank. The toner received in the toner tank may comprise latex, a colorant and a releasing agent. The lowest crossover temperature of the storage modulus (G') and the loss modulus (G") of the toner may be in the range of about 65 to about 80° C. The weight average molecular weight (Mw) of the toner may be in the range of about 65,000 to about 75,000. The z-average molecular weight (Mz) of the toner may be in the range of about 110,000 to about 220,000.

According to even still yet another aspect of the present disclosure, there is provided an imaging apparatus that may include an image carrier, a toner supplying unit and a toner transferring unit. The image carrier may have a surface capable of supporting thereon an electrostatic latent image. The toner supplying unit may be configured to supply toner onto the surface of the image carrier to thereby develop the electrostatic latent image into a toner image. The toner transferring unit may be configured to transfer the toner image from the surface of the image carrier to a print medium. The toner supplied by the toner supply unit may comprise latex, a colorant and a releasing agent. The lowest crossover temperature of the storage modulus (G') and the loss modulus (G") of the toner may be in the range of about 65 to about 80° C. The weight average molecular weight (Mw) of the toner may be in the range of about 65,000 to about 75,000. The z-average molecular weight (Mz) of the toner may be in the range of about 110,000 to about 220,000.

BRIEF DESCRIPTION OF THE DRAWINGS

Various features and advantages of the present disclosure will become more apparent by describing in detail exemplary embodiments thereof with reference to the attached drawings in which.

DETAILED DESCRIPTION OF SEVERAL EMBODIMENTS

Figure 1:
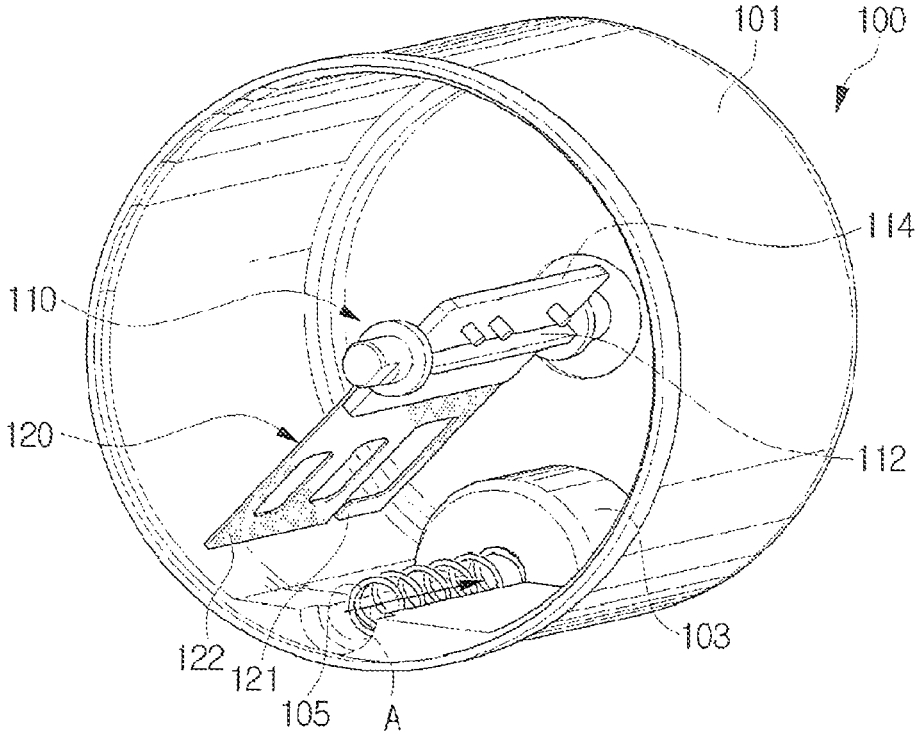
FIG. 1 is a perspective view of a toner supply unit according to an embodiment of the present disclosure.

The present disclosure will now be described more fully with reference to the accompanying drawings, in which several embodiments of the present disclosure are shown.

According to one aspect of the present disclosure, there is provided a toner for developing an electrostatic latent image that may comprise latex, a colorant and a releasing agent. With respect to such toner, the lowest crossover temperature of the storage modulus (G') and the loss modulus (G") at a temperature at or above 0° C. may be from about 65 to about 80° C., the weight average molecular weight (Mw) of the toner may be from about 65,000 to about 75,000, and the z-average molecular weight (Mz) of the toner may be from about 110,000 to about 220,000.

If the Mw of the toner is greater than or equal to about 65,000, the durability of the toner may be improved with reduced likelihood of cracking even when preserved at a relatively high temperature. If the Mw of the toner is less than or equal to about 75,000, a desirable fixing performance can be retained. The Mz of the toner may additionally or in the alternative be made to be in the range of about 110,000 to about 220,000 to provide the increased durability and the improvement in the fixing properties.

With regard to a toner according to an embodiment of the present disclosure, the lowest crossover temperature of the storage modulus (G') and the loss modulus (G") at a temperature at or above 0° C. may be from about 65 to about 80° C.

Generally speaking, the molecular weight (Mw) and the glass transition temperature (Tg) of toner has some influence on the storage modulus (G') and on the loss modulus (G") of the binder resin. For example, if both the Mw and the Tg are high, the binder resin may become rigid, resulting in an increase in the storage modulus (G'). On the other hand, if both the Mw and the Tg are low, an increase in the loss modulus (G") may result. However, since polymer materials used as a binder resin have both Mw and Tg characteristics, these materials cannot be characterized solely on any one factor. Instead, the lowest crossover temperature, which is the temperature greater than or equal to 0° C. at which the storage modulus (G') and the loss modulus (G") are substantially the same, may be used to characterize polymer materials for use as binder resin.

With respect to a toner according to an embodiment of the present disclosure, if the crossover temperature is at or above 65° C., the binder resin may have a high agglomeration force that allows a fixed image having a high level of rigidity and a desirable offset characteristics can be obtained. Further, if the crossover temperature is at or below 80° C., the binder resin may have suitable viscous characteristics that may advantageously allow the fixed image to have high bending resistance and high glossiness.

The toner may be manufactured by polymerization whereby the structure of toner is controlled by agglomerating micro-particles of latex, a pigment and a releasing, agent. For example, by using a metal salt such as $MgCl_2$ or NaCl as the agglomerating agent, the toner particle diameter and toner particle distribution may be controlled with some degree of reproducibility.

A toner according to an embodiment of the present disclosure may have a strong agglomeration force, and may be optimized by the inclusion of a metal salt including Si and Fe. In this regard, Si and Fe are harmless to humans and to the environment. When the toner is manufactured using a metal salt including Si and Fe as the agglomerating agent, the respective concentration of each of the Si and Fe may be from about 3 to about 1,000 ppm independently with respect to the concentration one another. That is, with the respective concentrations of the Si and Fe each being greater than or equal to 3 ppm, the desired agglomeration effects may be obtained. If the respective concentrations of the Si and Fe are each less than or equal to 30,000 ppm, the resulting toner may have excellent charging characteristics.

The molar ratio of Si to Fe (Si/Fe) may be within the range of about 0.1 to about 5, for example, or of about 0.15 to about 3. If the molar ratio (Si/Fe) is greater than or equal to about 0.1, the toner may have a strong agglomeration force. If the molar ratio (Si/Fe) is less than or equal to about 5, the toner may exhibit excellent charging characteristics.

Owing to the inclusion in the toner of the metal salt including Si and Fe as the agglomerating agent according to an embodiment, particles of small sizes may be formed. In addition, while the particle shape may not be all a perfectly spherical shape, a sufficiently narrow particle diameter range and sufficient circularity can be obtained. For example, with respect to toner according to one or more embodiments of the present disclosure, the average particle diameter may be in the range of about 3 to about 8 μm, and the average circularity may be in the range of about 0.940 to about 0.980. In addition, the volume average particle diameter distribution coefficient (GSDv) of the toner may be less than or equal to about 1.25 while the number average particle diameter distribution coefficient (GSDp) of the toner may be less than or equal to about 1.30. Thus, a narrow particle diameter distribution may be obtained in the toner according to one or more embodiments of the present disclosure.

According to an embodiment of the present disclosure, a method of manufacturing a toner for developing an electrostatic latent image may include the steps of a) mixing a latex particle, a colorant dispersion and a releasing agent dispersion to form a mixture; b) adding an agglomerating agent to the mixture to form a primary agglomerated toner; and c) heating the primary agglomerated toner to a temperature that is equal to or higher than the glass transition temperature of the latex particle to coalesce the primary agglomerated toner to form a secondary agglomerated toner, wherein with respect to the toner, the lowest crossover temperature of the storage modulus (G') and the loss modulus (G") at a temperature equal to or higher than 0° C. may be from about 65 to about 80° C., the Mw of the toner may be from about 65,000 to about 75,000, and the Mz of the toner may be from about 110,000 to about 220,000.

The latex particle may be formed of polyester, a polymer prepared by polymerizing at least one polymerizable monomer, or a mixture thereof (hybrid). If the latex particle is formed of a polymer, at least one polymerizable monomer may be polymerized together with a releasing agent in the polymerizing process, or the polymer may be mixed with the releasing agent. The polymerizing process may be an emulsion polymerization distribution process. As a result of the emulsion polymerization distribution process, the latex particle may have a particle size of about 1 μm or less, and may be in the range of, for example, about 100 to about 300 nm. The latex particle has high durability, and may thus control the agglomerating/unifying process. Highly durable resins may have a wide fixing region, and may be capable of enduring the high stress and heat that may be in an image development system of a printer, for example.

The at least one polymerizable monomer that may be used according to an embodiment may include, for example, at least one monomer selected from styrene-based monomers such as, for example, styrene, vinyltoluene, or α-methylstyrene; acrylic acids, methacrylic acids; derivatives of (meth) acrylic acid such as, for example, methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonirile, methacrylonirile, acrylamide, or methacrylamide; ethylenically unsaturated monoolefines such as, for example, ethylene; propylene, or butylene; halogenated vinyls such as vinyl chloride, vinylidene chloride, or vinyl fluoride; vinyl esters such as, for example, vinyl acetate or vinyl propionate; vinylethers such as, for example, vinylmethylether or vinylethylether; vinylketones such as, for example, vinylmethylketone or methylisoprophenylketone; and a nitrogen-containing vinyl compound such as, for example, 2-vinylpyridine, 4-vinylpyridine, or N-vinylpyrrolidone.

The latex particle may further include a charge controller that allows the toner to be supported or carried with sufficient stability on a development roller by the application of an electrostatic force. By the use of the charge controller, improvements in the stability and speed of the charging of the toner can be realized. The charge controller may be a negatively charged charge controller or a positively charged charge controller. Examples of the negatively charged charge controller may include, for example, an organic metal complex such as, for example, a chromium-containing azo complex or a monoazo metal complex, or chelate compounds; metal-containing salicylic acid compounds wherein the metal may be, for example, chromium, iron, or zinc; and organic metal complexes such as, for example, aromatic hydroxycarboxylic acids or aromatic dicarboxylic acid. However, the negatively charged charge controller may not be particularly limited to those listed above. In addition, a positive charge type charge control agent may be, for example, a modified product such as, for example, nigrosine and a fatty acid metal salt thereof, or an onium salt including a quaternary ammonium salt such as, for example, tributylammonium 1-hydroxy-4-naphthosulfonate and tetrabutylammonium tetrafluoro borate. These charge control agents may be used alone or in combination.

The latex particle, obtained as described above, may be mixed with the colorant dispersion and the releasing agent dispersion to prepare a mixed solution. The colorant dispersion may be obtained by uniformly dispersing a composition including a pigment, such as, for example, a black pigment, a cyan pigment, a magenta pigment, or a yellow pigment, and an emulsifier by using an ultrasonic homogenizer or a micro fluidizer.

Among pigments used to prepare the colorant dispersion, the black pigment may be a carbon black or aniline black. For color toner, at least one pigment selected from cyan pigment, magenta pigment and yellow pigment, may be used in addition to the black pigment.

The yellow pigment may be, for example, a condensation nitrogen compound, an isoindolinone compound, an anthraquine compound, an azo metal complex, or an alyl imide compound. Examples of the yellow pigment include C.I. pigment yellows. C.I. pigment yellow 12, 13, 14, 17, 62, 74, 83, 93, 94, 95, 109, 110, 111, 128, 129, 147, 168 and 180.

Examples of the magenta pigment may include condensation nitrogen compounds, anthraquine compounds, quinacridone compounds, base dye rate compounds, naphthol compounds, benzo imidazole compounds, thioindigo compounds and perylene compounds. Specific examples of the magenta pigment may include C.I. pigment reds 2, 3, 5, 6, 7, 23, 48:2, 48:3, 48:4, 57:1, 81:1, 122, 144, 146, 166, 169, 177, 184, 185, 202, 206, 220, 221 and 254.

Examples of the cyan pigment may include copper phthalocyanie compounds and derivatives thereof, anthraquine compounds and base dye rate compounds. Specific examples of the cyan pigment may include C.I. pigment blues 1, 7, 15, 15:1, 15:2, 15:3, 15:4, 60, 62 and 66.

These colorants may be used alone or in combination, and may be selected in consideration of color, chromacity, brightness, weather resistance, dispersibility in toner, or other factors.

The amount of the pigment used to prepare the colorant dispersion may be any amount that is sufficient to colorize toner. For example, according to an embodiment, the amount of the pigment may be in the range of about 0.1 to about 20 parts by weight based on 100 parts by weight of a polymerizable monomer.

The emulsifier used to prepare the colorant dispersion may be any known emulsifier, examples of which may include an anionic reactive emulsifier, a non-ionic reactive emulsifier, or a mixture thereof. The anionic reactive emulsifier may be, for example, HS-10 (available from Dai-Ichi Kogyo Seiyaku Co., Ltd. of Tokyo, Japan) or Dowfax® 2A1 (available from Rhodia Inc. of NJ, U.S.A.). The non-ionic reactive emulsifier may be, for example, RN-10 (available from Dai-Ichi Kogyo Seiyaku Co., Ltd.).

The releasing agent dispersion used in the method of preparing toner according to an embodiment may include, for example, a releasing agent, water, or an emulsifier. The releasing agent may enable the toner to be fixed to a final image receptor, e.g., a sheet of paper, at a low fixing temperature, and may allow the resulting image to have an excellent final image durability and abrasion-resistance characteristics. In general, for an oil-free fixing of the toner, and to improve the glossiness of the toner, the viscosity of toner may need to be lowered when the toner is dissolved. On the other hand, to prevent exfoliation of toner from paper or to prevent a hot-offset phenomenon, the viscosity of toner may need to be increased. As described above, in order to obtain high glossiness toner while preventing the toner exfoliation or the hot-offset phenomenon, the viscosity of the toner may need to be optimized. Such optimization may be achieved by controlling the degree of crosslinking in the toner, and by using a low melting point/low viscosity wax as the releasing agent. However, when, after agglomeration, a unifying process is performed at a temperature at or above the melting point of the low melting point/low viscosity wax used to obtain a high glossiness toner, the wax may have a fluidic dispersion structure, and thus may eventually appear at the surface of the toner particle. Due to the surface exposure of the wax, for example, the charging characteristics, thermal storage characteristics and fluidic characteristics of the toner may change. The problem however can be solved by adjusting the compatibility of the toner wax and the toner resin to optimize the viscosity of the toner to obtain high glossiness and a wide fixing region.

A suitable releasing agent may include, but is not limited to, polyethylene-based wax, polypropylene-based wax, silicon wax, paraffin-based wax, ester-based wax, carnauba wax, or metallocene wax. The melting point of the releasing agent may be, for example, in the range of about 50 to about 150° C. To adjust the compatibility and viscosity/elasticity with respect to the toner resin, a mixture including an ester-based wax having a high compatibility with respect to the toner resin and a paraffin-based wax having low compatibility with respect to the toner resin in an appropriate ratio, or an ester group-containing paraffin-based wax, may be used as the releasing agent. The amount of the releasing agent according to an embodiment may be in the range of about 1 to about 20 parts by weight based on 100 parts by weight of a polymerizable monomer.

Similar to the emulsifier used in the colorant dispersion, the emulsifier used in the releasing agent dispersion may be any known emulsifier, examples of which may include, an anionic reactive emulsifier, a non-ionic reactive emulsifier, and mixtures thereof. The anionic reactive emulsifier may be HS-10 (available from Dai-Ichi Kogyo Seiyaku Co., Ltd.), or Dowfax® 2A1 (available from Rhodia Inc.). The non-ionic reactive emulsifier may be RN-10 (available from Dai-Ichi Kogyo Seiyaku Co., Ltd.). For example, the releasing agent dispersion may have a composition ratio shown in Table 1:

TABLE 1

| | Releasing agent | | | |
|---|---|---|---|---|
| | P280(ref) | P419 | P420 | P421 |
| Paraffin wax | 25-35% | 20-30% | 25-35% | 25-35% |
| Synthesized ester wax | 5-10% | 10-20% relatively large amount | 5-10% relatively middle amount | 1-10% relatively small amount |
| Viscosity (mPa * s/ 25° C.) | 10 | 18 | 13 | 13 |
| Melting point (DSC) | 85° C. | 88° C. | 89° C. | 89° C. |

The latex particle, the colorant dispersion and the releasing agent dispersion, which are prepared as described above, may be mixed to prepare a mixed solution, to which mixed solution an agglomerating agent may be added to thereby form an agglomerated toner. Specifically, the latex particle, the colorant dispersion and the releasing agent dispersion may be mixed with a homogenizer, and to which mixture an agglomerating agent may be added at a temperature of about 25 to about 60° C., for example, or about 35 to about 50° C., to thereby form the primary agglomerated toner. Then, a unifying process may be performed at a temperature of about 85 to about 100° C. (a temperature that is higher than Tg by about 30 to 50° C.) to form a secondary agglomerated toner. In some cases, when the secondary agglomerated toner is formed, latex (secondary latex or tertiary latex) for forming a shell may further be used to coat the agglomerated toner. In this regard, the acidic value of releasing agent may be less than the acidic value of the primary latex, which is less than the acidic value of secondary latex, where the primary latex is a latex that is initially added to the mixed solution. The acidic values of primary and secondary latexes may be in the range of about 5 to about 10.

In the method described above, due to the increase in ionic strength by adding the Si and Fe containing metal salt as the agglomerating agent, the size of the primary agglomerated toner may increase. The Si and Fe containing metal salt may be poly silicairon. Examples of the Si and Fe containing metal may include, for example, product names PSI-025, PSI-050, PSI-075, PSI-100, PSI-200, PSI-300 (available from Suido Kiko Kaisha, Ltd. of Tokyo, Japan). Properties and compositions of these examples of agglomerating agents are shown in Table 2 below.

TABLE 2

| Type | | PSI-025 | PSI-050 | PSI-075 |
|---|---|---|---|---|
| Silica/Fe mole ratio (Si/Fe) | | 0.25 | 0.5 | 0.85 |
| Concentration | Fe(wt %) | 5.0 | 3.5 | 2.5 |
| | $SiO_2$(wt %) | 1.4 | 1.9 | 2.0 |
| pH (1 w/v %) | | | 2-3 | |
| Specific gravity (20° C.) | | 1.14 | 1.13 | 1.09 |
| Viscosity (mPa · S) | | | 2.0 or more | |
| Average molecular weight (Dalton) | | | 500,000 | |
| External appearance | | Yellowish brown transparent liquid | | |
| **Type** | | **PSI-100** | **PSI-200** | **PSI-300** |
| Silica/Fe mole ratio (Si/Fe) | | 1 | 2 | 3 |
| Concentration | Fe(wt %) | 2.0 | 1.0 | 0.8 |
| | $SiO_2$(wt %) | 2.2 | 2.2 | 2.2 |
| pH (1 w/v %) | | | 2-3 | |
| Specific gravity (20° C.) | | 1.08 | 1.06 | 1.04 |
| Viscosity (mPa · S) | | | 2.0 or more | |
| Average molecular weight (Dalton) | | | 500,000 | |
| External appearance | | Yellowish brown transparent liquid | | |

These agglomerating agents may have a strong agglomeration force even when used in a small amount at low temperature. These agglomerating agents can also be used even when rhodamine-based pigments, which are not likely to be agglomerated, are used. In particular, since these agglomerating agents use iron and silica as main components, the problem of conventional aluminum polymer agglomerating agents, that is, a harmful effect of the residual aluminum on humans and the environment, can be mitigated.

The secondary latex may be obtained by polymerizing the at least one polymerizable monomer described above. The polymerizing process may be an emulsion polymerization distribution process. As a result of the emulsion polymerization distribution process, the secondary latex may have a particle size of about 1 μm or less, and that ranges, for example, from about 100 to about 300 nm. The secondary latex may includes a releasing agent, which may be included in the secondary latex when at least one polymerizable monomer is polymerized.

A tertiary latex may be prepared by polymerizing the at least one polymerizable monomer described above, which may be further coated on the secondary agglomerated toner. By forming a shell layer using the secondary latex or the secondary and tertiary latex, the toner may exhibit a high durability and an excellent preservation characteristics during shipping and handling. In some case, a polymerization inhibitor may further be added to prevent the formation of new latex particles, and starved-feeding conditions may be used to appropriately coat a monomer mixed solution on the toner.

The obtained secondary agglomerated toner or tertiary agglomerated toner may be filtered to isolate the toner particles. The isolated toner particles may then be dried. An external additive may be added to the dried toner, and the amount of charge applied may be controlled to thereby obtain the final dry toner.

The external additive may be silica or $TiO_2$. The amount of the external additive may be in the range of about 1.5 to about 4 parts by weight, or of about 2 to about 3 parts by weight, based on 100 parts by weight of toner not including the external additive. If the amount of the external additive is within the above ranges, the likelihood of caking (i.e., the clumping together of the toner particles due to an agglomerating force) and a possible contamination of a roller by excessive external components may be reduced.

A developer according to an embodiment of the present disclosure may not have no other particular requirements except that it includes the toner according to one or more embodiments described above, and may include other components as necessary or appropriate for the desired purpose. In this regard, if the toner according to one or more embodiments described above is used alone, the resulting developer may be a one-component developer. If, on the other hand, such toner is used together with a carrier, the resulting developer may be a two-component developer. Recently, non-magnetic one-component developers are more commonly used to perform a development process due in part to the simplicity of equipment and the lower cost.

A carrier used in a two-component developer may be, for example, nickel, cobalt, iron oxide, ferrite, iron, or a glass bead. These carriers may be used alone or in combination. An average particle diameter of the carrier may be in the range of about 20 to about 150 μm. In addition, the carrier may be coated with a coating agent such as, for example, a fluorine-based resin, an acryl-based resin, or a silicon-based resin. Further, the carrier may be prepared by dispersing a magnetic material in a binder resin. The mixture ratio of the toner to the carrier may not be particularly limited, and may be appropriately selected suitable for the intended purpose.

An electrostatic imaging method according to an embodiment of the present disclosure may include the steps of: forming an electrostatic latent image on an image bearing member; forming a toner image by developing the electrostatic latent image with developer employing the toner described above; transferring the toner image onto a sheet of print medium; and fixing the transferred image by heat and/or pressure onto the sheet of print medium.

In particular, as an initial step, a charging process may be performed. During the charging process, a negative charge or a positive charge may be applied to the image bearing member by, e.g., using a corona charger or a charging roller. Then, an electrostatic latent image may be formed by performing an exposure process. During the exposing process, the charged surface of the image bearing member is selectively discharged to form the latent image using an optical system such as, for example, a laser scanner or a diode arrangement. The latent image is formed in an imagewise manner such that the latent image corresponds to the desired image to be formed on the final image receptor, e.g., on a sheet of print medium. The optical system may use an electromagnetic radiation, also referred to as "light," which may be, for example, infrared light radiation, visible light radiation, or ultra-violet light radiation.

In order to form the toner image, particles of the toner having a sufficient charge of a polarity are brought into contact with the latent image formed on the image bearing member. Conventionally, it is known to use a developing unit having the same charge polarity as that of the charge of the toner, to which developing unit an electrical biased may or may not be applied. Consequently, the toner particles may move toward the image bearing member, and may be attached selectively to the latent image portion of the image bearing member due to an electrostatic force to thereby form the toner image on the image bearing member.

A transferring process to transfer the toner image onto a final image receptor may the be performed. During the transferring process, the toner image is transferred from the image bearing member to the final image receptor, e.g., a sheet of print medium. In some cases, as is known to those skilled in the art, an intermediate transferring element may be used to transfer the toner image from the image bearing member to the final image receptor.

A fixing process may then be performed to fix or fuse the toner image on the final image receptor. Particularly, during the fixing process, the toner image being carried on the final image receptor may be heated so that the particles of the toner are softened or dissolved, and are fixed to the final image receptor. Alternatively, the toner image may be fixed to the final image receptor by compression at high pressure in lieu of or in addition to the application of the heat.

Then, a cleaning process may additionally be performed to remove the residual toner remaining residual on the image bearing member. Finally, a charge-removing process may be performed, during which process the image bearing member may be exposed to a light having a specific wavelength band to thereby reduce the charge on the image bearing member to a uniform low value. Thus, the residue of the latent image may be removed from the image bearing member, thus making the image bearing member available for a subsequent imaging cycle.

A toner supply unit according to an embodiment of the present disclosure may include a toner tank for storing therein a developer containing the toner, a supplying part arranged to project into the toner tank and to discharge the toner from the toner tank and a toner agitating member rotatably disposed inside the toner tank to agitate the toner stored in the toner tank. According to an embodiment, the toner agitating member is configured in such a manner to agitate the toner in almost an entire inner space of the toner tank, including the locations at the vicinity of the top surface of the supplying part. The toner used to develop an electrostatic latent image according to an embodiment may include latex, a pigment and a releasing agent, wherein the toner includes Si and Fe each in a concentration of about 3 to about 1,000 ppm, wherein with respect to the toner, the lowest crossover temperature of the storage modulus (G') and the loss modulus (G") at a temperature equal to or higher than 0° C. may be from about 65 to about 80° C.; wherein the weight average molecular weight (Mw) of the toner may be in the range of about 65,000 to about 75,000; and wherein the z-average molecular weight (Mz) of the toner may be in the range of about 110,000 to about 220,000.

For example, FIG. 1 shows a toner supplying apparatus 100 according to an embodiment of the present disclosure. The toner supplying apparatus 100 may include a toner tank 101, a supplying part 103, a toner-conveying member 105 and a toner-agitating member 110. The toner tank 101 may store therein an amount of toner, and may be formed, for example, in a substantially hollow cylindrical shape. The supplying part 103 may be disposed at the bottom inner portion of the toner tank 101, and may operate to discharges the toner from stored the toner tank 101 out of the toner tank 101. For example, the supplying part 103 may be arranged at the bottom portion of the toner tank 101 so as to protrude into the toner tank 101, and may have, according to an embodiment, as shown in FIG. 1, a pillar shape with a semi-circular cross-section. The supplying part 103 may include a toner outlet (not shown) through which the toner is discharged out of the toner tank 101.

The toner-conveying member 105 may be disposed adjacent the supplying part 103 at the bottom portion of the toner tank 101. The toner-conveying member 105 may be formed as, for example, a coil shaped spring. An end of the toner-conveying member 105 may be received into the supplying part 103 so that, when the toner-conveying member 105 rotates, the toner in the toner tank 101 is conveyed to toward and into the supplying part 103 in the direction indicated by the arrow 'A.' The toner conveyed by the toner-conveying member 105 is discharged to the outside through the toner outlet of the supplying part 103.

The toner-agitating member 110 may be rotatably disposed inside the toner tank 101, and may operated to cause a movement of the toner in the toner tank 101 in a radial direction. For example, when the toner-agitating member 110 rotates in the middle of the toner tank 101, the toner particles in the toner tank 101 are agitated or stirred. That is, the toner particles may be carried by the toner-agitating member 110 from the bottom of the toner tank 101 to the top portion of the toner tank 101, and may fall downwards toward the bottom of the toner tank 101 by its own weight. Such movement of the toner particles may prevent the particles from solidifying or clumping together into lumps. The toner-agitating member 110 may include a rotation shaft 112 and a toner agitating film 120. The rotation shaft 112 may be rotatably disposed in the middle of the toner tank 101, and may have a driving gear (not shown) coaxially coupled with an end of the rotation shaft 112 projecting from a side of the toner tank 101. Thus, the rotation of the driving gear causes the rotation shaft 112 to rotate. The rotation shaft 112 may additionally have a wing plate 114 to help mounting the toner agitating film 120 to the rotation shaft 112. The wing plate 114 may be formed to be substantially symmetric about the rotation shaft 112. The toner agitating film 120 has a width that correspondingly spans the inner length of the toner tank 101.

According to an embodiment of the present disclosure, in order to affectively agitate the toner in the toner tank 101, and to prevent the toner from collecting and forming lumps in the vicinity of the top of the supplying part 103, the toner agitating film 120 may be made to be elastically deformable. For example, the toner agitating film 120 may be capable of bending when interfered by a projection inside the toner tank 101, e.g., the supplying part 103. Further, according to an embodiment, the toner agitating film 120 may be cut to form a first agitating part 121 and a second agitating part 122 so as to allow the first agitating part 121 to agitate the toner at the vicinity of the top surface the supplying part 103 in better conformity with the surface of the supplying part 103. The toner-agitating member 110 of the configuration described above may thus be capable of reaching substantially the entire inter volume of the toner tank 101, including the top surface of the supplying part 103.

An imaging apparatus according to an embodiment of the present disclosure includes: an image bearing member; an imaging unit for forming an electrostatic image on the image bearing member; a unit for containing the toner; a toner supply unit for supplying the toner to the image bearing member so as to develop the electrostatic image into a toner image on the image bearing member; and a toner transfer unit for transferring the toner image formed on the image bearing member to a transfer medium, wherein the toner used to develop the electrostatic latent image may include latex, a colorant and a releasing agent, wherein the toner may further include Si and Fe each in a concentration of about 3 to about 1,000 ppm, wherein with respect to the toner, the lowest crossover temperature of the storage modulus (G') and the loss modulus (G") at a temperature equal to or higher than 0° C. may be in the range of about 65 to about 80° C.; wherein the weight average molecular weight (Mw) of the toner may be in the range of about 65,000 to about 75,000; and wherein the z-average molecular weight (Mz) of the toner may be in the range of about 110,000 to about 220,000.

Figure 2:
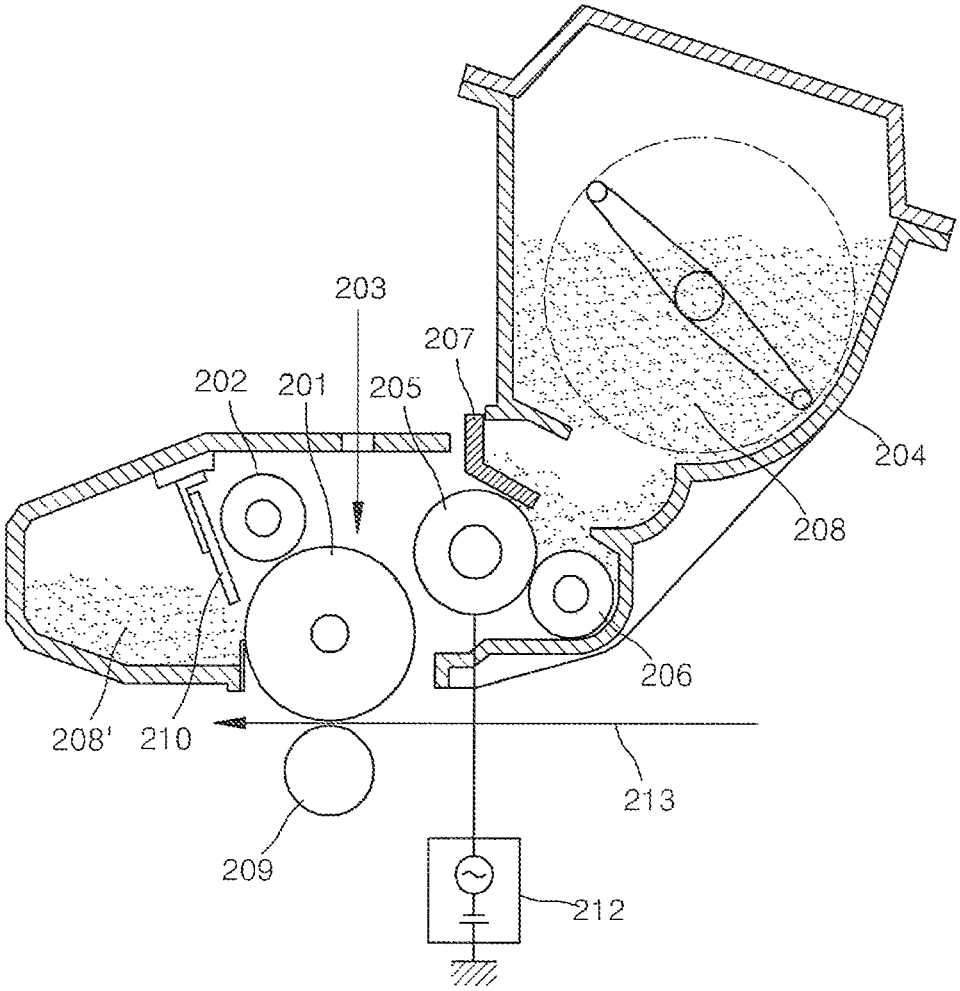
FIG. 2 is a schematic sectional view of an imaging apparatus according to an embodiment of the present disclosure.

FIG. 2 shows an example of a non-contact development type imaging apparatus including toner prepared using a method according to an embodiment of the present disclosure. In a developing device 204, a nonmagnetic one-component developer (for example, toner) 208 may be supplied to a developing roller 205 by a supply roller 206 that may be formed of an elastic material, such as polyurethane foam or sponge. The developer 208 supplied to the developing roller 205 may reach a contact portion between a developer controlling blade 207 and the developing roller 205 due to the rotation of the developing roller 205. The developer controlling blade 207 may be formed of an elastic material, such as, for example, metal or rubber. When the developer 208 passes through the contact portion between the developer controlling blade 207 and the developing roller 205, the developer 208 is formed into a thin layer, which may have a substantially uniform thickness, and which may be charged to certain potential level. So formed and charged layer of developer 208 is brought to a development region of a photoreceptor 201, which is an example of an image bearing member, to develop the latent image being carried on the photoreceptor 201. The latent image is formed by exposing to a light 203 selective portions of a uniformly charged surface of the photoreceptor 201 to create a pattern of charge, potential differences across the surface of the photoreceptor 201 corresponding to the intended image, and may thus be invisible prior to the development thereof.

The developing roller 205 may be arranged to face the photoreceptor 201 and to be spaced apart from the photoreceptor 201 by a predetermined distance. The developing roller and the photoreceptor 201 may be made rotate in rotational directions opposite to each other. For example, the developing roller 205 may be made to rotate in the counter-clockwise direction while the photoreceptor 201 is made to rotate in the clockwise direction.

The developer 208, which has been transferred to the development region of the photoreceptor 201, develops the latent image into visible form by an electrical or electrostatic force generated by the potential difference between the developing roller 205, to which a voltage that may include a direct current (DC) bias and/or alternating current (AC) voltage may be applied, and the latent potential of the photoreceptor 201. The developer 208 becomes transferred from the developing roller 205 to selective portions of the photoreceptor 201 according to the potential difference in the latent image so as to form a visible developer image on the photoreceptor 201. Prior to the formation of the latent image by exposure to the light 203, the surface of the photoreceptor 201 may be charged to a uniform potential by a charging unit 202 so as to provide a clean canvas on which the latent image can be drawn.

Subsequent to the development of the latent image, the developer 208, which has been transferred to the photoreceptor 201, reaches a transfer unit 209 due to the rotation direction of the photoreceptor 201, and is transferred from the photoreceptor 201 to a print medium 213 that passes between the photoreceptor 201 and the transfer unit 209, which may be, e.g., a roller to which a high voltage having a polarity opposite to the charged developer 208 may be applied. The residual charges remaining on the photoreceptor 201 may then be removed, for example, by a light exposure or by corona discharging subsequent to the transfer of the toner image to the print medium 213.

The print medium 213 carrying the transferred toner image may be made to pass through a high temperature and high pressure fusing device (not shown), causing the developer 208 of the toner image to be fused to the print medium 213 and to thereby complete the formation of the image. The non-developed, residual developer 208 remaining residual on the developing roller 205 may be collected by the supply roller 206 that contacts the developing roller 205. The non-transferred, residual developer 208' remaining residual on the photoreceptor 201 may be collected by a cleaning blade 210 into a waste developer container. The above-described image forming processes may be repeated as necessary to form additional images.

For further illustration of various aspects of the present disclosure, several specific examples will now be described. It should be understood however that these examples are for illustrative purposes only, and are not intended to limit the scope of the present disclosure.

EXAMPLES

Example 1

Synthesis of Latex

A monomer mixed solution (970 g of styrene, 192 g of n-butyl acrylate, and 26 g of 2-carboxylethylacrylate (e.g., Sipomer available from Rhodia Inc. of NJ, U.S.A.), 4.2 g of 1,10-decandiol diacrylate as a cross-linker, 18.8 g of 1-dodecanethiol constituting a chain transfer agent (CTA), and 500 g of sodium dodecyl sulfate (available from, e.g., Sigma-Aldrich Co. of St. Louis, Mo., U.S.A.) aqueous solution (2% compared to water) constituting an emulsifier are added to a 3 L beaker, and the resulting mixture is stirred to prepare a monomer-emulsified solution.

Separately, 18 g. of an initiator (ammonium persulfate (APS)) and 1,160 g of sodium dodecyl sulfate (available from, e.g., Sigma-Aldrich Co.) aqueous solution (0.13% with respect to water) constituting an emulsifier are added to a 3 L double-jacketed reactor and heated to a temperature of 75° C. While stirring the mixture including the initiator and sodium dodecyl sulfate, the prepared monomer emulsified-solution is slowly added into the mixture over at least two hours. The reaction is performed for 8 hours at the reaction temperature to obtain a primary latex. The particle size of the primary latex particle is measured using a light scattering-type Horiba 910 (available from Horbia, Ltd. of Kyoto, Japan). The average particle size measured is from about 150 to about 200 nm. In this case, the Mw of the latex is about 66,000.

Preparation of Colorant Dispersion 10 g of the sum of an anionic reactive emulsifier (e.g., HS-10 available from Dai-Ichi Kogyo Seiyaku Co., Ltd.) and a non-ionic reactive emulsifier (e.g., RN-10 available from Dai-Ichi Kogyo Seiyaku Co., Ltd.) in a ratio shown in the table below, and 60 g of pigment (Black, Cyan, Magenta, Yellow) are loaded into a milling bath. 400 g of glass beads having a diameter of 0.8 to 1 mm is added thereto, and a milling operation is performed on the mixture at room temperature, to obtain a dispersion. The homogenizer used in this experiment may be an ultrasonic homogenizer or a micro fluidizer.

| Color | pigment | HS-10:RN-10 (ratio) | Particle Size |
|---|---|---|---|
| Black | Mogul-L | 100:0 | 130 nm |
| | | 80:20 | 120 nm |
| | | 0:100 | 100 nm |
| Yellow | PY-74 | 100:0 | 350 nm |
| | | 50:50 | 290 nm |
| | | 0:100 | 280 nm |
| Magenta | PR-122 | 100:0 | 320 nm |
| | | 50:50 | 300 nm |
| | | 0:100 | 290 nm |
| Cyan | PB 15:3 | 100:0 | 130 nm |
| | | 80:20 | 120 nm |
| | | 80:30 | 120 nm |

Agglomeration and Preparation of Toner 15 g of a nitric acid (0.3 mol) and 15 g of PSI-025 (available from Suido Kiko Kaisha, Ltd. of Tokyo, Japan) constituting the agglomerating agent are added to a mixed solution of 5.00 g of deionized water, 150 g of the primary latex particles as a core, 35 g of cyan colorant dispersion (HS-10 100%), and 28 g of releasing agent dispersion P-280 (available from Chukyo yushi Co., Ltd. of Nagoya, Japan) in a 1 L reactor. The mixture is stirred using a homogenizer, at a rate of about 11,000 rpm for 6 minutes, thereby obtaining a primary agglomerated toner having a particle size of about 1.5 to 2.5 The resultant mixed solution is added to a 1 L double jacketed reactor, and the temperature is increased by 0.5° C. per minute from room temperature to 50° C. (a temperature equal to or higher than $T_g$-5 degrees of latex). When the volume average diameter (D50) of the primary agglomerated toner reaches about 5.8 μm, 50 g of a secondary latex obtained by polymerizing polystyrene-based polymerizable monomers is added thereto. When the volume average particle diameter (D50) is from about 6.0 μm, NaOH (1 mmol) is added to the reaction solution to control the pH level of the reaction solution to be about 7. When the volume average particle diameter has been maintained constant for 10 minutes, the temperature is increased to 96° C. at a rate of about 0.5° C./min. When the temperature is about 96° C., a nitric acid (0.3 mol) is added to the reaction solution to control the pH level to be about 6.6. The reaction may be performed for 3 to 5 hours to obtain a secondary agglomerated toner having a potato-like shape and a particle size of about 5 to 6 μm. The agglomerated reaction solution is cooled to a temperature lower than $T_g$, a filtering operation is performed to isolate the toner particles, and the toner particles are dried.

External additives are added to the toner by adding 0.5 parts by weight of NX-90 (available from Nippon Aerosil Co., Ltd. of Osaka, Japan), 1.0 parts by weight of RX-200 (available from Nippon Aerosil Co., Ltd.), and 0.5 parts by weight, of SW-100 (available from Titan Kogyo, Ltd. of Ube, Japan) to 100 parts by weight of the dried toner particles. The mixture is stirred using a mixer (e.g., KM-LS2K available from Dae Hwa Tech Co., Ltd. of Busan, Korea) at a rate of 8,000 rpm for 4 minutes. The resultant toner has the volume average particle diameter (D50) of 5.9 μm.

Example 2

Preparation of Toner

Toner may be prepared in the same manner as in Example 1, except the Mw of latex used is 70K, and the Mw of the obtained toner is 74K.

Example 3

Preparation of Toner

Toner may be prepared in the same manner as in Example 1, except the Mw of latex used is 65K, and the Mw of the obtained toner is 68K.

Example 4

Preparation of Toner

Toner may be prepared in the same manner as in Example 1, except the Mw of latex used is 68K, and the Mw of the obtained toner is 71K.

Comparative Example 1

Toner may be prepared in the same mariner as in Example 1, except the Mw of latex used is 48K, and the Mw of the obtained toner is 51K.

Comparative Example 2

Toner may be prepared in the same manner as in Example 1, except the Mw of latex used is 81 K, and the Mw of the obtained toner is 85 K.

Toner Evaluation

1. Flowability Evaluation

Flowability evaluation may be performed using a temperature sweep method whereby an oscillation frequency is fixed and the temperature is increased; and/or a frequency sweep method whereby the temperature is increased and an oscillation frequency is changed. The specific evaluation conditions used are as follows:

temperature sweep method: equipment used: ARES rheometer available from TA Instruments of New Castle, Del., U.S.A., temperature increase rate of 2° C./min, 40 to 180° C., and frequency of 6.28 rad/s; and frequency sweep method: equipment used: ARES rheometer available from TA Instruments, measurement temperature of 140° C., Frequency in the range of 0.1 to 100 rad/s.

2. Weight Average Molecular Weight (Mw) & Z-average Molecular Weight (Mz)

Mw and Mz may be measured by gel permeation chromatography (e.g., using a Refractive Index Detector model 2414 available from Waters Corporation of Milford, Mass., U.S.A.).

3. Fixing Characteristics Evaluation

Equipment: Belt-type fixer (Color laser 660 available from Samsung Electronics Co., Ltd, of Seoul, Korea)

Un-fixed image for test: 100% pattern

Test temperature: 100 to 200° C. (an interval of 10° C.)

Fixing speed: 160 mm/sec

Fixing time: 0.08 sec

This experiment may be performed under the conditions described above, and the fixing characteristics of the fixed image are evaluated.

The OD of the fixed image is measured. A 3M 810 tape is attached to the fixed image and 500 g of a weight is reciprocated thereon five times, and the tape used is removed. The OD of the fixed image is then measured again Fixing characteristics (%)=(OD_after tape peeling/OD_before tape, peeling)×100

A fixing temperature range in which 90% or more of the fixed image remains is regarded as a toner fixing range.

MFT: Minimum Fusing Temperature [minimum temperature at which 90% or more of the fixed image remains without cold-offset HOT: Hot Offset Temperature [minimum temperature at which hot-offset occurs]

4. Glossiness Evaluation

A glossmeter for measuring a degree of glossiness (e.g., micro-TRI-gloss available from BYK Gardner of Columbia, Md., U.S.A.) is used at a temperature of 160° C. at which the fixer is used.

Measurement angle: 60°

Measurement pattern: 100% Pattern

5. High Temperature Preservation Evaluation

After external additives are added to 100 g of the toner, the toner is loaded into a developing device (e.g., Color laser 660 available from Samsung Electronics Co., Ltd.). The resultant developing device is placed in a constant-temperature and constant-humidity oven under the following conditions:

23° C., 55% RH (Relative Humidity) 2 hours

=>40° C., 90% RH 48 hours

=>50° C., 80% RH 48 hours

=>40° C., 90% RH 48 hours

=>23° C., 55% RH 6 hours

Visual Observation is made to determine whether caking occurred in the toner in the developing device. A 100% image is printed to evaluate any image defects.

Evaluation Reference

○: good image quality, No-Caking

Δ: poor image quality, No-Caking x: Caking

6. Toner Agglomeration Evaluation (Carr's Cohesion)

Equipment: Hosokawa micron powder tester PT-S (available from Hosokawa Micron Ltd. of United Kingdom)

Amount of sample: 2 g (toner that contains external additives, or toner that does not contain external additives)

Amplitude: 1 mm_dial 3~3.5

Sieve: 53, 45, 38 μm

Oscillation Time: 120 seconds

After the sieves are placed at a temperature of 23° C. in RH 55% for 2 hours, the amount of toner in the respective sieves is measured before and after this experiment is performed under the conditions described above.

(1) [(Mass of powder in the largest sieve)/2 g]×100

(2) [(Mass of powder in the middle sieve)/2 g]×100×(3/5)

(3) [(Mass of powder in the smallest sieve)/2 g]×100×(1/5)

Carr's Cohesion=(1)+(2)+(3)

7. Charge Characteristics Evaluation 28.5 g of a carrier and 1.5 g of toner are loaded into a 60 mL gloss container and stirred with a tubular mixer. An electric field separation method is used to measure the particle charge. Charge stability of toner according to a mixing time at room temperature in room humidity and a ratio of a charge amount at high temperature in high humidity (HH) to a charge amount at low temperature in low humidity (LL), are used as evaluation indices.

room temperature and room humidity: 23° C., RH 55%

HH: 32° C., RH 80%

LL: 10° C., RH 10%

TABLE 3

Summary of Evaluation Result

| | G' & G" crossover temp | Mw | Mz | Degree of Gloss 160 mm/s | Fixing Characteristics MFT | 80 mm/s HOT | Charging Stability | Charging HH/LL | Flowability | High-temp preservation |
|---|---|---|---|---|---|---|---|---|---|---|
| Example 1 | 65° C. | 65360 | 180000 | ○ | 130° C. | 230° C. | ○ | ○ | ○ | ○ |
| Example 2 | 66° C. | 74320 | 213800 | ○ | 140° C. | 240° C. | ○ | ○ | ○ | ○ |
| Example 3 | 65° C. | 68010 | 175000 | ○ | 130° C. | 230° C. | ○ | ○ | ○ | ○ |
| Example 4 | 66° C. | 71010 | 207000 | ○ | 140° C. | 240° C. | ○ | ○ | ○ | ○ |
| Comparative Example 1 | 57° C. | 51480 | 105300 | ○ | 120° C. | 200° C. | Δ | X | Δ | X |
| Comparative Example 2 | 70° C. | 85470 | 308600 | X | 170° C. | 230° C. | X | Δ | ○ | ○ |

Referring to Table 3, the toners manufactured according to Examples 1 to 4 have a higher charging HH/LL ratio, better flowability and better high-temperature preservation characteristics than the toners manufactured according to Comparative Examples 1 and 2.

According to an embodiment of the present disclosure, toner that has high image quality and high durability and which may be used to develop an electrostatic latent image may be manufactured.

While the present disclosure has been particularly shown and described with reference to several embodiments thereof, it will be understood by those of ordinary skill in the art that various changes in form and details may be made thereto without departing from the principles and spirit of the present disclosure, the proper scope of which is defined in the following claims and their equivalents.

What is claimed is:

1. A toner for developing an electrostatic latent image comprising latex, a colorant and a releasing agent, wherein a lowest crossover temperature of the toner is in the range of about 65 to about 80° C., the lowest crossover temperature being a temperature at which a storage modulus (G') of the toner substantially equals a loss modulus (G") of the toner, wherein a weight average molecular weight (Mw) of the toner is in the range of greater than 65,000 to about 75,000, and wherein a z-average molecular weight (Mz) of the toner is in the range of about 110,000 to about 220,000.

2. The toner of claim 1, wherein the toner further comprises Si and Fe each in a concentration of about 3 to about 30,000 ppm.

3. The toner of claim 2, wherein a molar ratio of Si to Fe (Si/Fe) is in the range of about 0.1 to about 5.

4. The toner of claim 1, wherein the average particle diameter (D50) of the toner is in the range of about 3 to about 8 μm.

5. The toner of claim 1, wherein the average circularity of the toner is in the range of about 0.940 to about 0.980.

6. The toner of claim 2, wherein the volume average particle diameter distribution coefficient (GSDv) of the toner is about 1.25 or less, and wherein the number average particle diameter distribution coefficient (GSDp) is about 1.30 or less.

7. A method of preparing a toner for developing an electrostatic latent image, comprising:

mixing a latex particle, a colorant dispersion and a releasing agent dispersion to form a mixture;

adding an agglomerating agent to the mixture to form a primary agglomerated toner; and heating the primary agglomerated toner to a temperature that is equal to or higher than the glass transition temperature of the latex particle to coalesce the primary agglomerated toner to form a secondary agglomerated toner, wherein a lowest crossover temperature of the toner is in the range of about 65 to about 80° C., the lowest crossover temperature being a temperature at which a storage modulus (G') of the toner substantially equals a loss modulus (G") of the toner, wherein a weight average molecular weight (Mw) of the toner is in the range of greater than 65,000 to about 75,000, and wherein a z-average molecular weight (Mz) of the toner is in the range of about 110,000 to about 220,000.

8. The method of claim 7, wherein the latex particle comprises polyester alone, a polymer formed by polymerizing at least one polymerizable monomer, or a mixture thereof.

9. The method of claim 8, wherein the at least one polymerizable monomer comprises at least one compound selected from styrene-based monomers, acrylic acids, methacrylic acids, derivatives of (meth)acrylic acid, ethylenically unsaturated monoolefines, halogenated vinyls, vinyl esters, vinylethers, vinylketones and nitrogen-containing vinyl compounds.

10. The method of claim 9, wherein the styrene-based monomer comprises at least one compound selected from styrene, vinyltoluene and α-methylstyrene, wherein the derivatives of (meth)acrylic acid comprises at least one compound selected from methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide, wherein the ethylenically unsaturated monoolefine comprises at least one compound selected from ethylene, propylene and butylene, wherein the halogenated vinyl comprises at least one compound selected from vinyl chloride, vinylidene chloride and vinyl fluoride, wherein the vinyl ester, comprises at least one compound selected from vinyl acetate and vinyl propionate, wherein the vinylether comprises at least one compound selected from vinylmethylether and vinylethylether, wherein the vinylketone comprises at least one compound selected from vinylmethylketone and methylisopropheylketone, and wherein the nitrogen-containing vinyl compound comprises at least one compound selected from 2-vinylpyridine, 4-vinylpyridine and N-vinylpyrrolidone.

11. The method of claim 7, further comprising, after the primary agglomerated toner is formed, adding a secondary latex.

12. The method of claim 7, wherein the releasing agent dispersion comprises a mixture of a paraffin-based wax with an ester-based wax; or an ester group-containing paraffin-based wax.

13. The method of claim 7, wherein the agglomerating agent comprises a Si and Fe containing metal salt.

14. The method of claim 13, wherein the Si and Fe containing metal salt comprises polysilicate iron.

15. A developer for developing an electrostatic latent image, comprising:

a carrier; and a toner comprising latex, a colorant and a releasing agent, wherein a lowest crossover temperature of the toner is in the range of about 65 to about 80° C., the lowest crossover temperature being a temperature at which a storage modulus (G') of the toner substantially equals a loss modulus (G") of the toner, wherein a weight average molecular weight (Mw) of the toner is in the range of greater than 65,000 to about 75,000, and wherein a z-average molecular weight (Mz) of the toner is in the range of about 110,000 to about 220,000.

16. The method of claim 7, wherein the latex particle has a particle size that ranges from about 100 to about 300 nm.

17. The method of claim 7, wherein the secondary latex particle has a particle size that ranges from about 100 to about 300 nm.

18. The method of claim 7, wherein the agglomerating agent is added to the mixture at a temperature of about 25 to about 60° C. to form the primary agglomerated toner.

19. The method of claim 7, wherein an acidic value of the latex is in a range of about 5 to about 10 and an acidic value of the secondary latexes is in a range of about 5 to about 10.

* * * * *